United States Patent [19]

Campoli et al.

[11] 3,978,792

[45] Sept. 7, 1976

[54] PROJECTILE-TO-CARTRIDGE CASE ATTACHMENT

[75] Inventors: Ralph F. Campoli, Mine Hill, N.J.; Edwin G. Steiner, Waterloo, Iowa; Dennis L. Purtilo, Waterloo, Iowa; Thomas A. Lynch, Waterloo, Iowa

[73] Assignee: The United States of America as represented by the Secretary of the Army, Washington, D.C.

[22] Filed: Apr. 25, 1975

[21] Appl. No.: 571,672

[52] U.S. Cl. ..... 102/38; 102/93; 102/DIG. 1; 102/DIG. 7

[51] Int. Cl.[2] ..... F42B 5/02

[58] Field of Search ..... 102/38, 93, DIG. 7, 102/DIG. 1

[56] References Cited

UNITED STATES PATENTS

| | | | |
|---|---|---|---|
| 2,996,992 | 8/1961 | Critchfield | 102/93 |
| 3,100,448 | 8/1963 | Hablutzel | 102/93 |
| 3,476,048 | 11/1969 | Barr et al. | 102/DIG. 7 |
| 3,750,578 | 8/1973 | Blajda | 102/DIG. 1 |

*Primary Examiner*—Harold Tudor
*Attorney, Agent, or Firm*—Nathan Edelberg; A. Victor Erkkila; Max Yarmovsky

[57] ABSTRACT

A cartridge case adapter member is adapted to fit over a fin hub member of a fin stabilized projectile and is securely held thereto by the combination of an interlocking retainer sleeve and retainer plug. The combination projectile-to-combustible cartridge case attachment permits the projectile subassembly to pass a standard five foot drop test.

2 Claims, 6 Drawing Figures

PROJECTILE-TO-CARTRIDGE CASE ATTACHMENT

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to removably attach a round having a tail fin assembly to a combustible cartridge case so that both items could be simultaneously loaded into a launching weapon. In the prior art these two members were joined together by a threaded joint. The problem with this prior art construction was that the threaded assembly would not pass a United States MIL-STD 311, Test No. 111, standard drop test criteria. In addition, not only did the prior art fail the drop test, but the threads in the polypropylene cartridge case attachment had to be made oversize to provide sufficient retention of the projectile during initial loading placed upon it by the ignited propellant. As a result of the use of an oversize thread for the cartridge case attachment many parts were vulnerable to damage during assembly of the cartridge case attachment to the projectile, and as a result of this damage many parts had to be rejected.

SUMMARY OF THE INVENTION

The present invention relates to a projectile-to-cartridge case adapter design which, because of its greater strength than previously used threaded attachments, is able to successfully withstand a United States MIL-STD 311, Test No. 111 drop test. A cartridge case adapter member has gussets which extend over the fin hub portion of the projectile to provide rigidity and reduce the force transmitted to the joint between it and the projectile. An interlocking retainer sleeve and retainer plug attachment are used to hold the cartridge case adapter to the combustible case and the projectile.

An object of the present invention is to provide an attachment between the projectile and the combustible case which successfully passes a five foot drop test.

Another object of the present invention is to provide a projectile-to-cartridge case attachment which is rigid and reduces the force transmitted to the joint between it and the projectile.

Another object of the present invention is to provide a projectile-to-cartridge attachment which is not vulnerable to damage during assembly of the projectile to the cartridge attachment adapter.

A further object of the present invention is to provide a projectile-to-cartridge attachment which allows the projectile and cartridge case adapter to separate as required under dynamic firing conditions.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
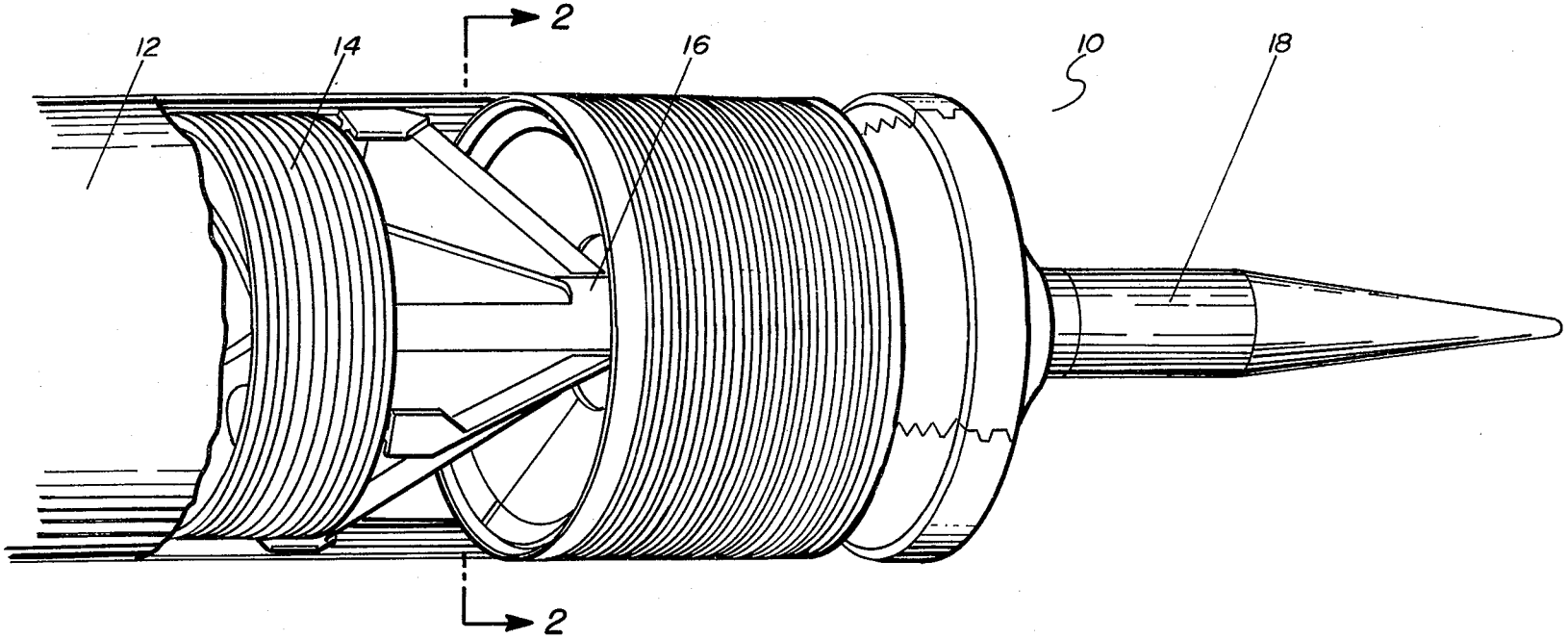
FIG. 1 is a partial cutaway isometric view of the projectile and cartridge case with the projectile-to-cartridge case adapter in its operative positions.

Referring now to FIG. 1 a fin stabilized projectile sub-assembly 10 is partially contained within a combustible cartridge case 12. A cartridge case adapter 14, which is in contact with case 12, and made of a polycarbonate resin material such as manufactured by General Electric Co., of Schenectady, N.Y., engages the fin hub 16 and supports the sub-projectile 18 when the cartridge assembly is being handled.

Figure 3:
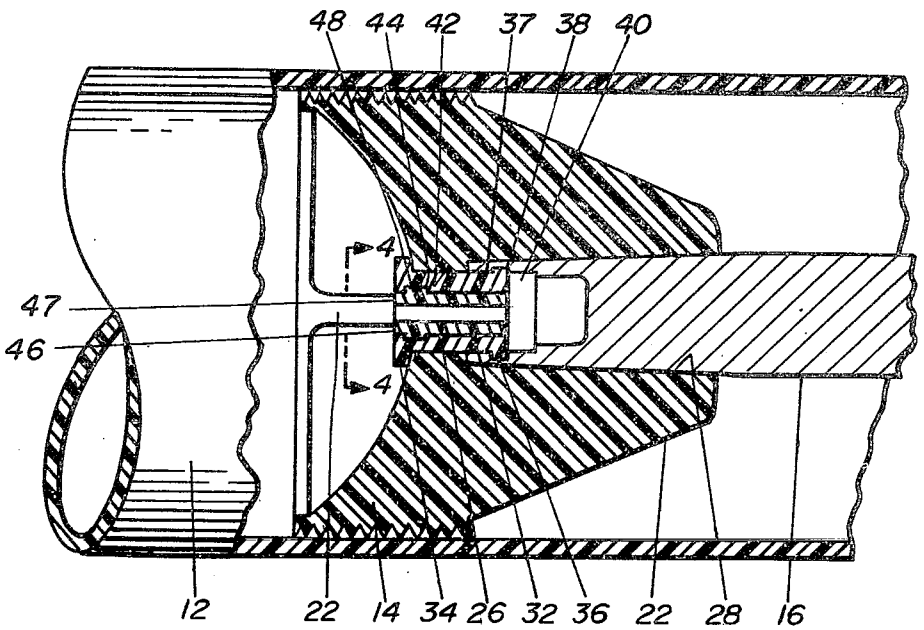
FIG. 3 is a partial longitudinal cross-sectional view taken along line 3—3 of FIG. 2.
Figure 2:
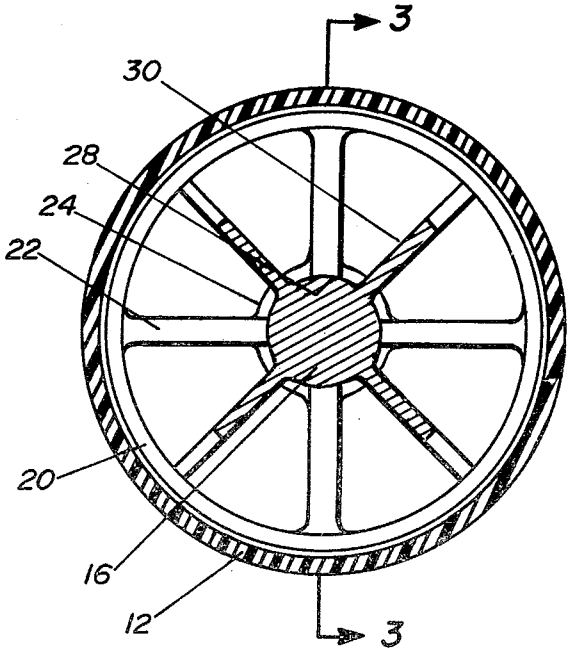
FIG. 2 is a cross-sectional view taken along line 2—2 of FIG. 1.

Referring to FIGS. 2 and 3 cartridge case adapter 14 has a hollow cylindrical section 20 which integrally supports thereon a plurality of equally spaced, triangularly shaped, radial gussets 22. The gussets 22 are integrally interconnected at their base ends by an integral cylindrically-shaped inner locking member 24 which has an axial adapter sleeve bore 26 therein. The inner gusset edges 28 are contoured to fit the outside surface of fin hub 16. Fin hub 16 has a plurality of triangularly shaped equally spaced fins 30 thereon. A retainer sleeve 32 has a first shoulder end 34 which abuts against the bottom side of the inner locking member 24 and a second shoulder end 36 which passes through fin hub axial bore 37 and fits within fin hub annular groove 38 which in turn communicates with a fin hub tracer cavity 40. Retainer sleeve 36 has an axial sleeve bore 42 and an annular retainer sleeve annular groove 44 therein. A tubularly shaped retainer plug 46, having an annular shoulder 48 on the outer surface near first end 47, fits into the retainer axial sleeve bore 42 so that the retainer plug annular shoulder 48 is located in retainer sleeve annular groove 44.

Figure 6:
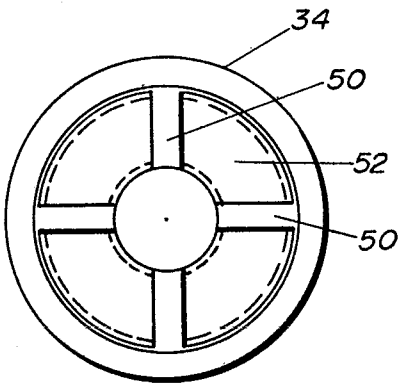
FIG. 6 is an end view of the retainer sleeve taken along line 6—6 of FIG. 5.
Figure 5:
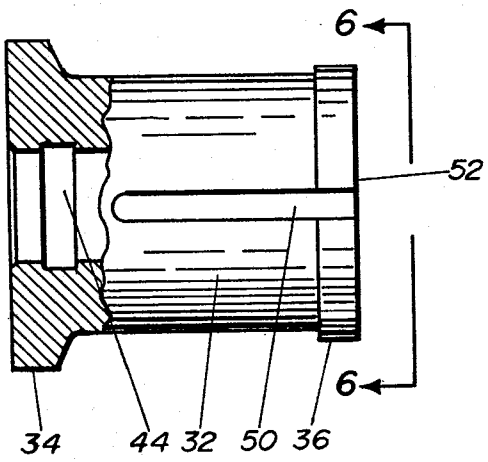
FIG. 5 is a partial cross-sectional view of the retainer sleeve taken along line 5—5 of FIG. 4.
Figure 4:
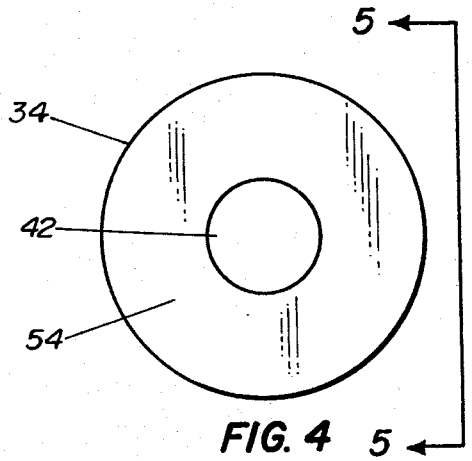
FIG. 4 is an end view of the retainer sleeve taken along line 4-4 of FIG. 3.

Referring now to FIGS. 4–6 the retainer sleeve 32 has a plurality of longitudinal slots 50 which go through the second shoulder 36 forming a slotted forward end 52 in contradistinction to the solid rear end 54.

During assembly, the cartridge case adapter 14 is mounted over the fin hub 16 portion of the sub-projectile 18 with the gusset members 22 seated on the fin hub 16. The retainer sleeve 32, which may be made of such plastic material as LEXAN, is aligned so that the slotted forward end 52 is concentric with the axial adapter sleeve bore 26, and as forward force is applied to the sleeve rear end 54, the slotted forward end 52 contracts allowing the pie shaped slotted ends 52 to enter adapter sleeve bore 26 and the fin hub axial bore 37. When the first shoulder of retaining sleeve 34 is seated against the inner cylindrical locking member 24 the slotted forward end 52 expands into the fin hub annular groove 38 thus locking the cartridge case adapter 14 to the subprojectile 18. The retainer plug 46, which may be made of material such as LEXAN, is then forced into the retainer sleeve 32 with its annular shoulder 48 engaging retainer sleeve annular groove 44. Thus positioned, plug 46 is trapped in retainer sleeve 32 and in turn prevents the contraction of the slotted forward end 52, thereby positively locking the cartridge case adapter 14 to projectile 18. The aforedescribed projectile-to-combustible cartridge case attachment passes the standard MIL-STD five foot drop test successfully.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secure:

1. A projectile-to-combustible cartridge case attachment for a fin-stabilized projectile which comprises:

a cartridge case adapter having a hollow cylindrical section which integrally supports thereon a plurality of equally spaced, radial gusset members seated on the fin hub of said projectile, said gusset members connected at their base ends by an integral, cylindrically shaped locking member having an axial adapter sleeve bore therein; and self-locking means for holding said cartridge case adapter to the fin hub of said fin stabilized projectile which includes;

first axially insertable means, operatively disposed within said locking member, for holding said locking member against the fin hub, which includes;

a retainer sleeve having a first shoulder end which abuts against said locking member, a second slotted forward end having a second shoulder thereon, said sleeve having an axial sleeve bore therein and a retainer sleeve annular groove which communicates with said sleeve bore, and second axially insertable means, operatively positioned within said first axially insertable means, for preventing said first insertable means from being withdrawn from said locking member and positively locking said cartridge case adapter to said projectile, which includes;

a tubularly shaped retainer plug having an annularly positioned shoulder on one end of said plug, said plug being forcibly disposed in said axial sleeve bore so that the shoulder of said plug fits into said retainer sleeve annular groove, said cartridge case adapter being mounted over said fin hub with said gusset members being seated on said fin hub and said slotted sleeve forward end being operatively positioned within said adapter sleeve bore into a fin hub axial bore and annular fin hub groove, said slotted forward shoulder end expanding into said fin hub annular groove, said retainer plug being forced into said retainer sleeve axial bore with said annular plug shoulder engaging said retainer sleeve annular groove, thereby trapping said retainer sleeve slotted second shoulder end in said fin hub groove and locking said cartridge case adapter to said projectile.

2. A projectile-to-combustible cartridge case attachment as recited in claim 1 wherein said cartridge case adapter, retainer sleeve and said retainer plug are made of a plastic polycarbonate resin material.

* * * * *